US006213643B1

(12) United States Patent
Lin

(10) Patent No.: US 6,213,643 B1
(45) Date of Patent: Apr. 10, 2001

(54) COLLAPSIBLE BAG EXPANDER

(76) Inventor: Chih-Ta Lin, 33rd. Fl. (Ocean Tower 2 Bldg.), 75/86-87, Soi Wattana, Sukhumvit 21 Rd. (Asoke), Kwang North Klongtoey, Khet Wattana, Bangkok 10110 (TH)

( * ) Notice: Subject to any disclaimer, the term of this patent is extended or adjusted under 35 U.S.C. 154(b) by 0 days.

(21) Appl. No.: 09/556,786

(22) Filed: Apr. 25, 2000

(51) Int. Cl.[7] ..... B65D 33/02
(52) U.S. Cl. ..... 383/127; 229/122.23
(58) Field of Search ..... 383/127; 229/122.23, 229/122.24, 122.26

(56) References Cited

U.S. PATENT DOCUMENTS 1,480,377 * 1/1924 Daly ..... 229/122.23
3,428,234 * 2/1969 DuBarry, Jr. ..... 229/122.23
5,259,674 * 11/1993 Hedaya et al. ..... 383/127
5,322,362 * 6/1994 Smith ..... 383/127
5,499,874 * 3/1996 Tang ..... 383/127
5,758,974 * 6/1998 Markowitz ..... 383/127
5,967,406 * 10/1999 Moorman ..... 229/122.26

* cited by examiner

*Primary Examiner*—Stephen P. Garbe
(74) *Attorney, Agent, or Firm*—Varndell & Varndell, PLLC

(57) ABSTRACT

A collapsible bag expander made by bending a patterned cardboard into shape, enabling coupled pairs of hooked portions of border flaps of panels of the patterned cardboard to be respectively secured together by elastic bands so that the bag expander is automatically forced by the spring power of the elastic band to expand and to support the collapsible bag in shape after removable of the collapsible bag from the polybag, which packs the collapsible bag in the collapsed condition.

2 Claims, 10 Drawing Sheets

COLLAPSIBLE BAG EXPANDER

BACKGROUND AND SUMMARY OF THE INVENTION

The present invention relates to a collapsible bag expander, and more particularly to such a collapsible bag expander, which is made of a patterned cardboard, and which expands automatically to support the collapsible bag in shape after removal of the collapsible bag from the packing material.

In order to support a backpack, travel bag, or any of a variety of collapsible bag in shape for exhibition, stuffing paper or like material is commonly used to stuff the bag. However, it is inconvenient to stuffing a collapsible bag with stuffing material. Further, when collapsing the collapsible bag, the stuffing material must be taken away. In order to eliminate these problems, various bag expander means have been developed. FIGS. 1 and 2 show a prior art bag expander for this purpose. This structure of bag expander is comprised of two folding panels and a stretcher connected between the folding panels. The stretcher has two coupling flaps at two distal ends respectively fastened to a respective coupling hole on each folding panel. This structure of bag expander is not satisfactory in function because it tends to be deformed and, the stretcher tends to be forced away from the coupling hole on each folding panel. FIGS. 3 and 4 show another structure of bag expander according to the prior art. This structure of bag expander comprises two symmetrical expander elements or substantially U-shaped cross section coupled together, and spring means fastened to the expander elements to secure the expander elements in the extended position. The expander elements each have two side panels, and coupling means at the side panels. The coupling means at the side panels of one expander element are respectively fastened to the coupling means at the side panels of the other expander element. The spring means are respectively fastened to the coupled coupling means to secure the expander elements in the extended position. Further, the side panels of the expander elemenets can be folded inwards to collapse the bag expander. This structure of bag expander has less industrial value because it is complicated and expansive.

The present invention has been accomplished to provide a bag expander, which eliminates the aforesaid drawbacks. It is one object of the present invention to provide a bag expander, which is simple and inexpensive. It is another object of the present invention to provide a bag expander, which automatically extends out to support the bag in shape after removal of the bag from the packing material. According to one embodiment of the present invention, the bag expander is compirised of a patterned cardboard, which is folded into a three-dimensional configuration to support the bag in shape, and two elastic bands, which secure the patterned cardboard in the folded shape. The patterned cardboard comprises a base panel, the base panel having a top side, a bottom side, and two opposite lateral sides, two opposite side panels extended from the two opposite lateral sides of the base panel, two supporting flaps respectively longitudinally extended from the side panels at a top side, and two coupling flaps respectively transversely extended from two opposite lateral sides of the bottom panel in reversed directions, the side panels each having a hooked portion remote from the supporting flaps, the coupling flaps each having a hooked portion respectively hooked up with the hooked portions of the side panels. The elastic bands are respectively fastened to the coupled hooked portions of the side panels and the coupling flaps to secure the patterned cardboard in the folded shape.

DETAILED DESCRIPTION OF THE PREFERRED EMBODIMENT

Figure 2:
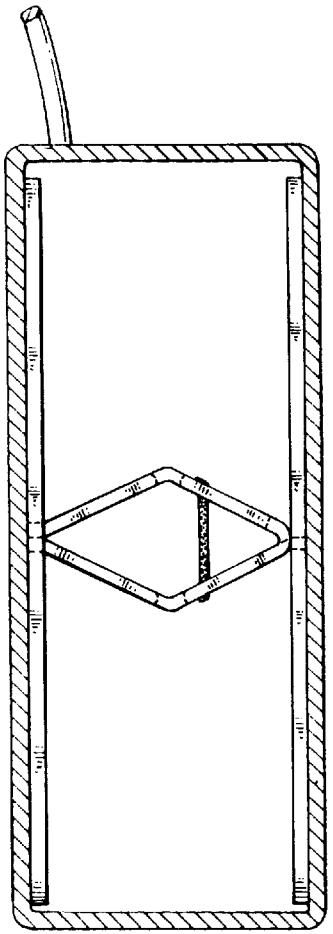
Fig. 2 PRIOR ART
FIG. 2 illustrates the prior art bag expander and collapsible bag of FIG. 1 set in the expanded condition.
Figure 1:
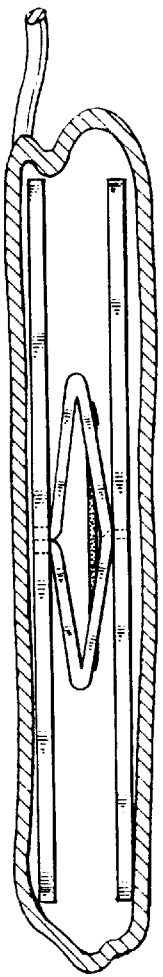
Fig. 1 PRIOR ART
FIG. 1 illustrates a prior art bag expander installed in a collapsible bag and collapsed.
Figure 4:
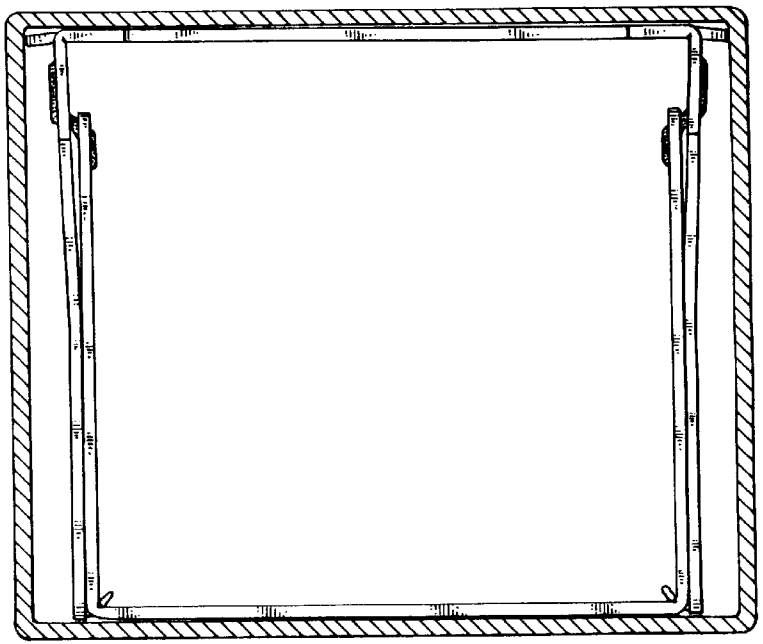
Fig. 4 PRIOR ART
FIG. 4 illustrates the prior art bag expander and the collapsible bag of FIG. 3 set in the expanded condition.
Figure 3:
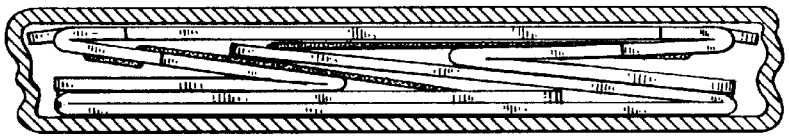
Fig. 3 PRIOR ART
FIG. 3 illustrates another structure of prior art bag expander installed in a collapsible bag and collapsed.
Figure 5:
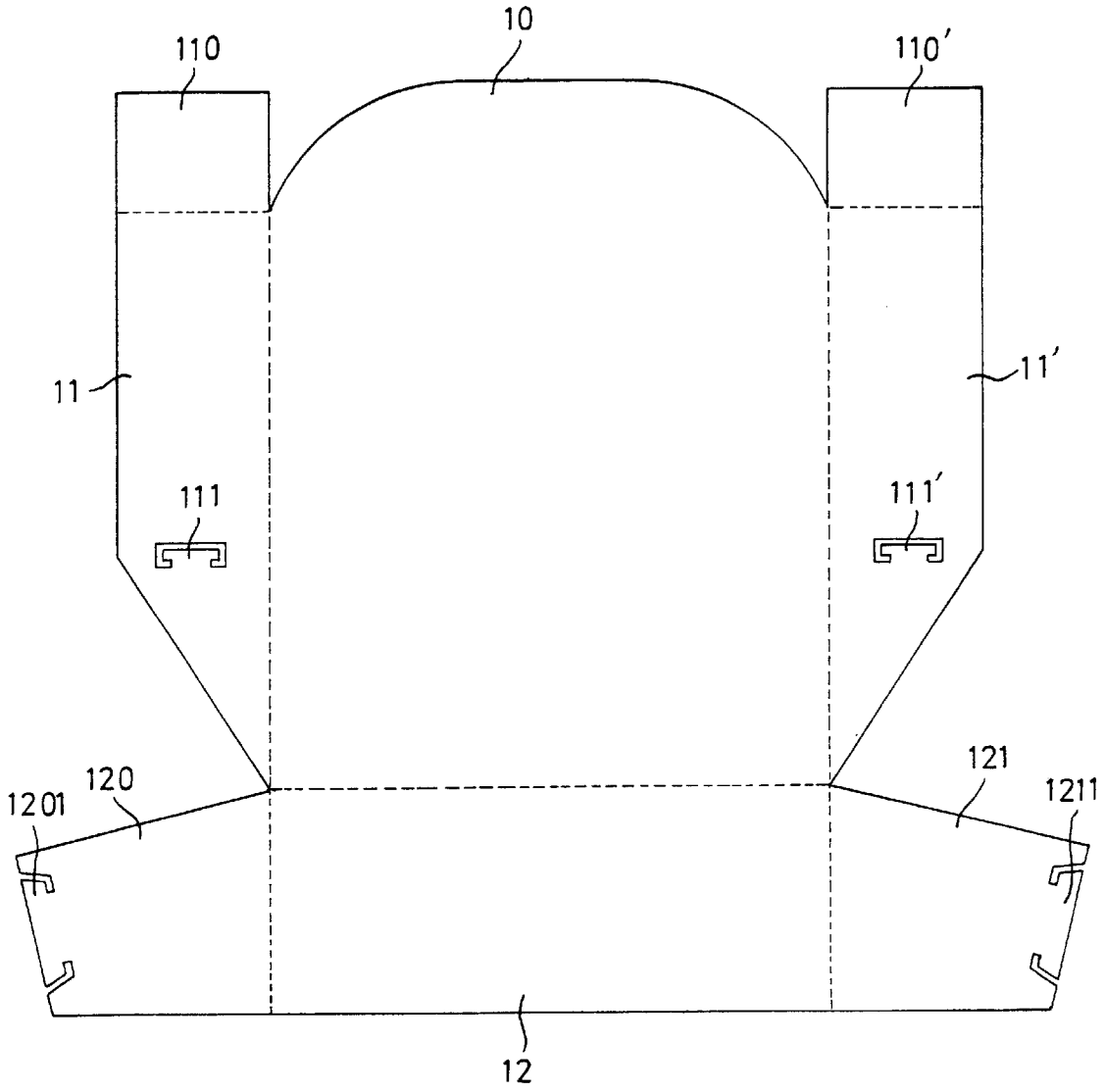
FIG. 5 is an extended plain view of a bag expander according to a first embodiment of the present invention.
Figure 6:
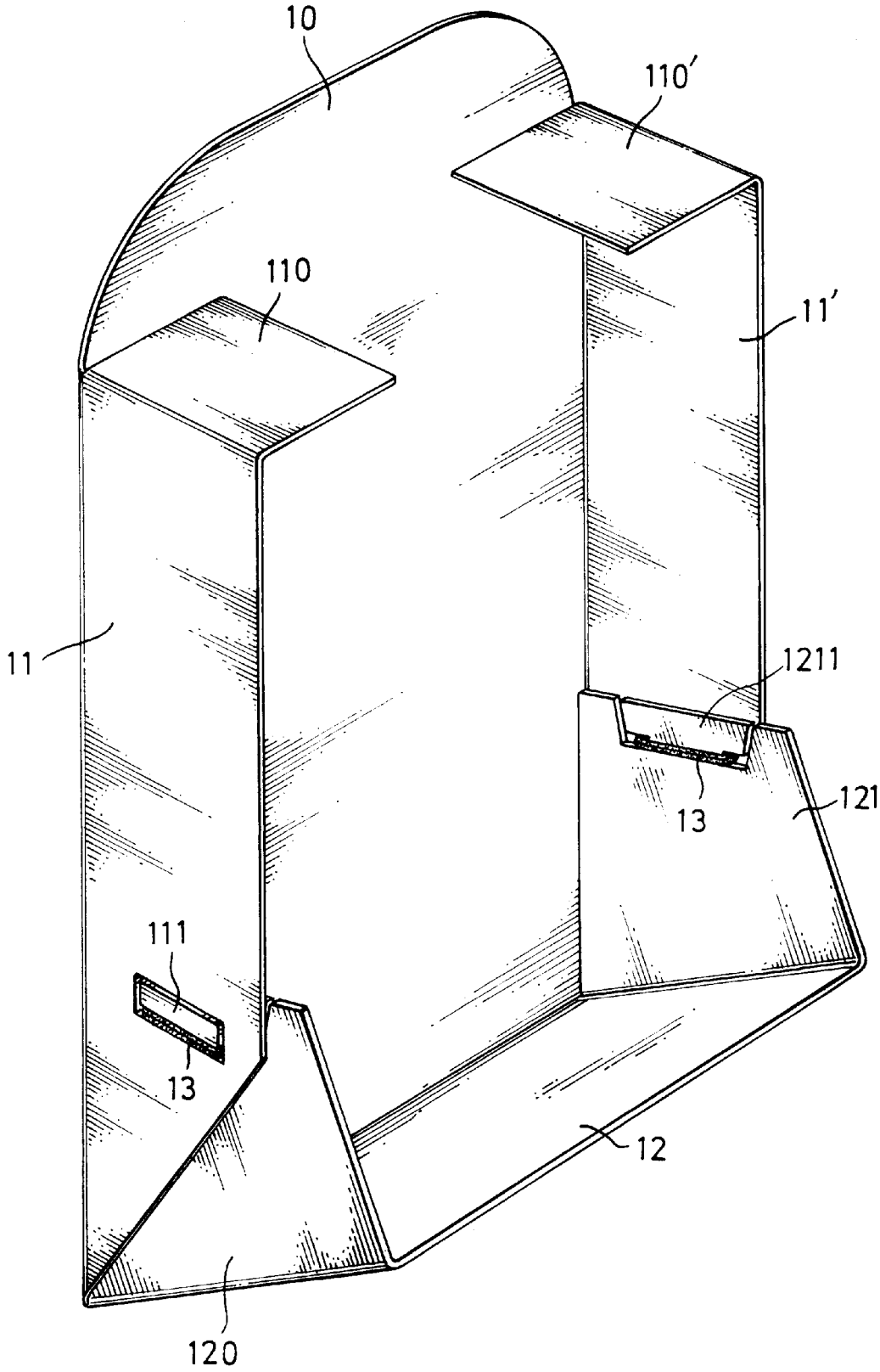
FIG. 6 is a perspective view of the bag expander according to the first embodiment of the present invention.

Referring to FIGS. 5 and 6, a collapsible bag expander is made of a patterned card board and adapted to expand a bag, comprising a base panel 10, which fits the back panel of the bag to be expanded, two opposite side panels 11 and 11' extended from two opposite lateral sides of the base panel 10, which fit the two opposite side panels of the bag to be expanded, and a bottom panel 12 extended from the bottom side of the base panel 10, which fits the bottom panel of the bag to be expanded, two supporting flaps 110 and 110' respectively longitudinally extended from the side panels 11 and 11' at a top side, and two coupling flaps 120 and 121 respectively transversely extended from two opposite lateral side of the bottom panel 10 in reversed directions. The side panels 11 and 11' each have a hooked portion 111 or 111' remote from the supporting flaps 110 or 110'. The coupling flaps 120 and 121 each have a hooked portion 1201 or 1211 for hooking up with the hooked portion 111 or 111' of one side panel 11 or 11'. The coupling flaps 120 and 121 are respectively bent inwards, and then the bottom panel 12 and the side panels 11 and 11' are respectively bent inwards relative to the base panel 10, and then the hooked portions 1201 and 1211 of the bottom panel 12 are respectively hooked up with the hooked portions 111 and 111' of the side panels 11 and 11', and then two elastic bands 13 are respectively fastened to the hooked portions 111 and 1201; 111' and 1211 to secure the bottom panel 12 and the side panels 11 and 11' in the coupled condition, and then the supporting flaps 110 and 110' are respectively bend inwards and perpendicularly disposed in contact with the base panel 10, and thus the collapsible bag expander is set in the operative position (see FIG. 6).

Figure 7:
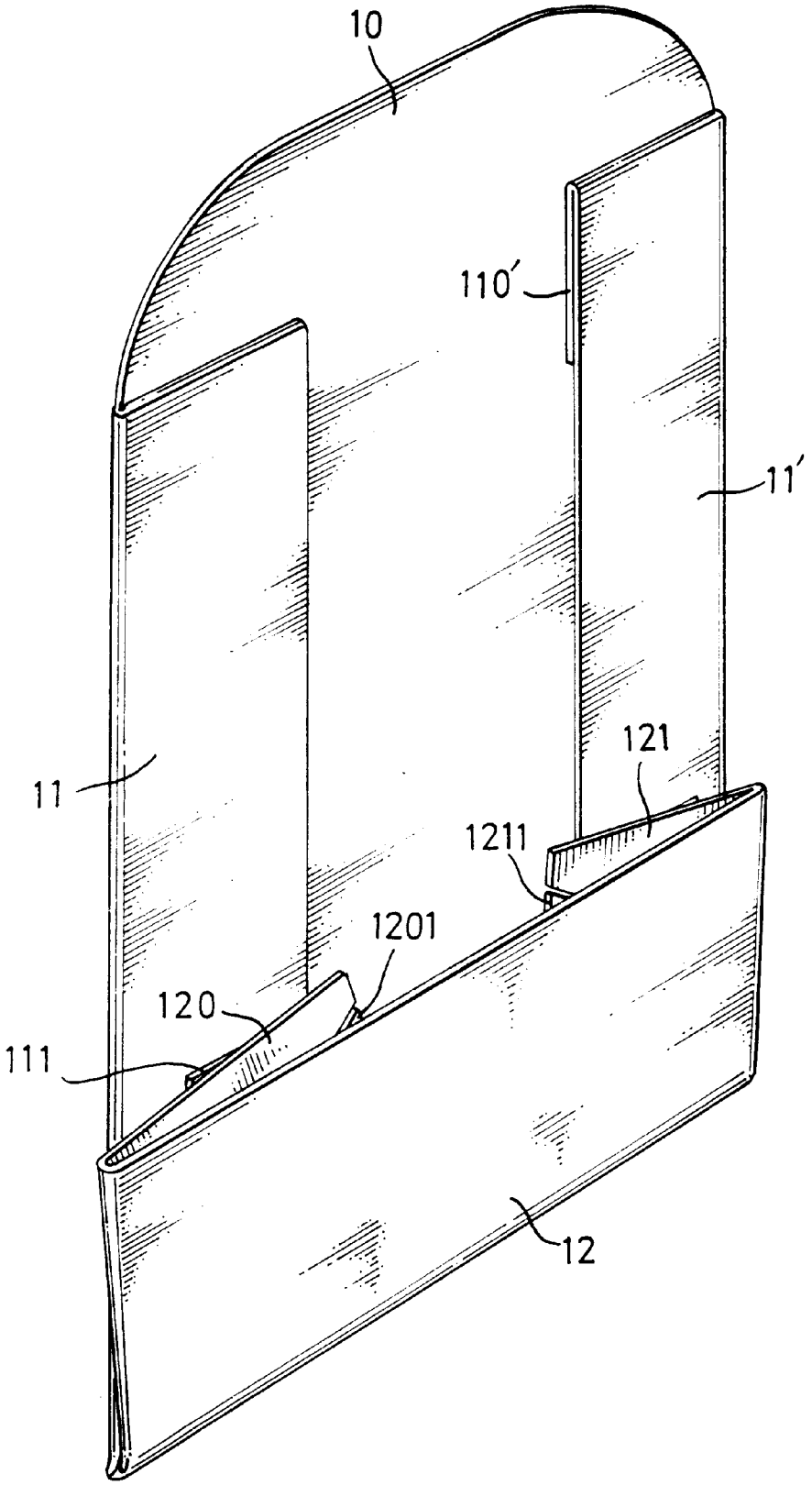
FIG. 7 illustrates the bag expander of the first embodiment of the present invention collapsed.
Figure 10:
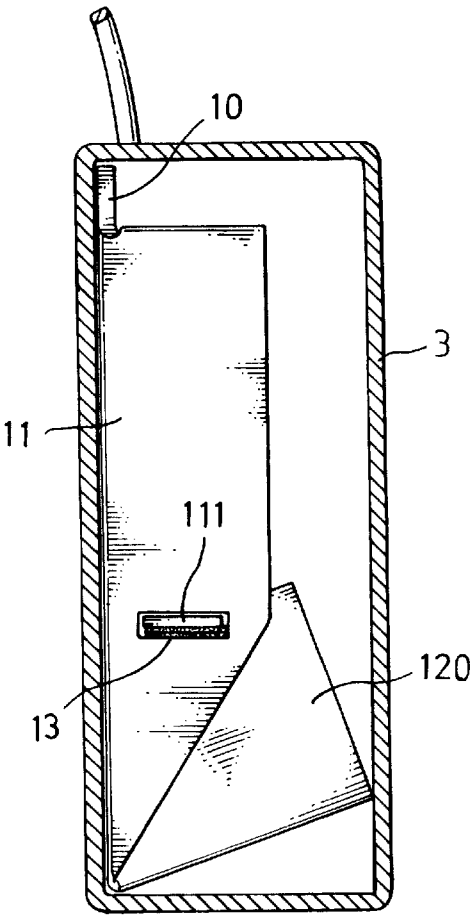
FIG. 10 is a sectional view showing the backpack and the bag expander expanded according to the present invention.
Figure 9:
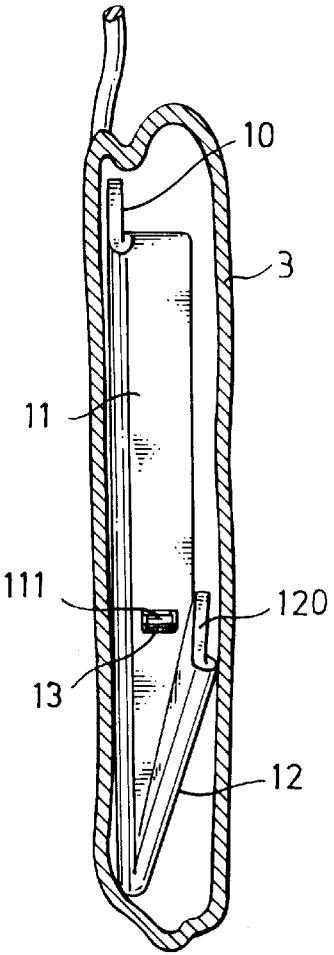
FIG. 9 is a sectional view showing the bag expander collapsed with the backpack according to the present invention.
Figure 8:
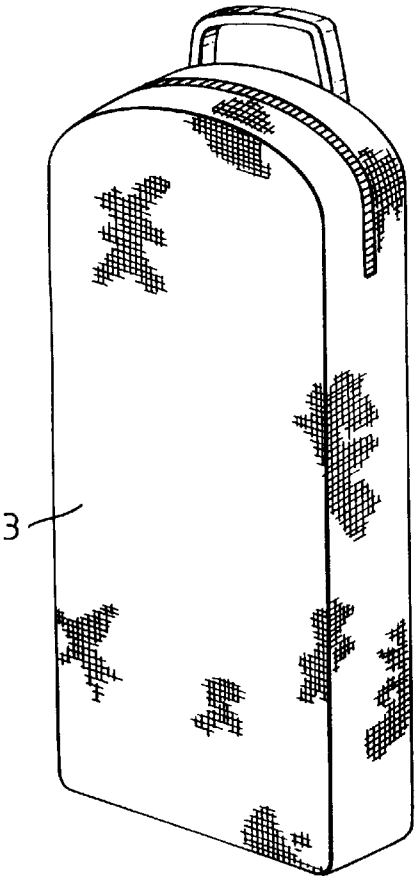
FIG. 8 is a perspective view of a backpack when expanded according to the present invention.

Referring to FIGS. 7 and 6, before inserting into the bag to be expanded, the supporting flaps 110 and 110' are respectively bent inwards and closely attached to the inner surface of the side panels 11 and 11', and then the bottom panel 12 and the side panels 11 and 11' are respectively bent inwards and closely attached to the surface of the base panel 10, enabling the side panels 11 and 11' to be retained between the base panel 10 and the bottom panel 12, and thus the collapsible bag expander is collapsed (see FIG. 7).

Referring to Figures from 8 through 10, the collapsed bag expander is inserted into a bag, for example, a backpack 3. Because the backpack 3 is packed in a polybag, the collapsible bag expander is retained in the collapsed condition inside the backpack 3 under the constraint of the polybag. After removal of the bakcpack 3 from the polybag, the backpack 3 is shaken with the hands, enabling the collapsible bag expander to be forced by the spring power of the elastic bands to extend from the collapsed position shown in FIG. 7 to the expanded position shown in FIG. 6 to support the backpack 3 in shape.

Figure 11:
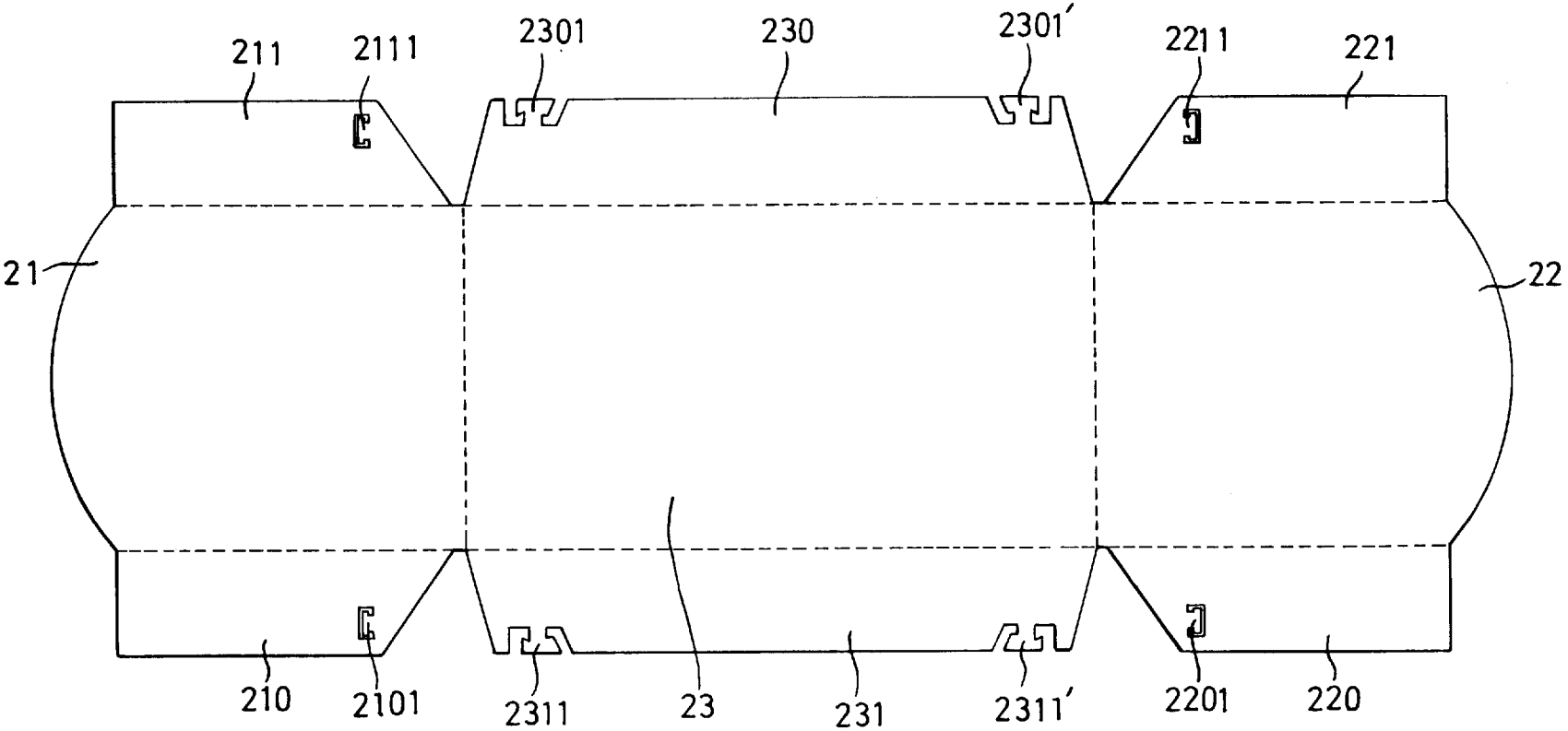
FIG. 11 is extended plain view of a bag expander according to a second embodiment of the present invention.
Figure 12:
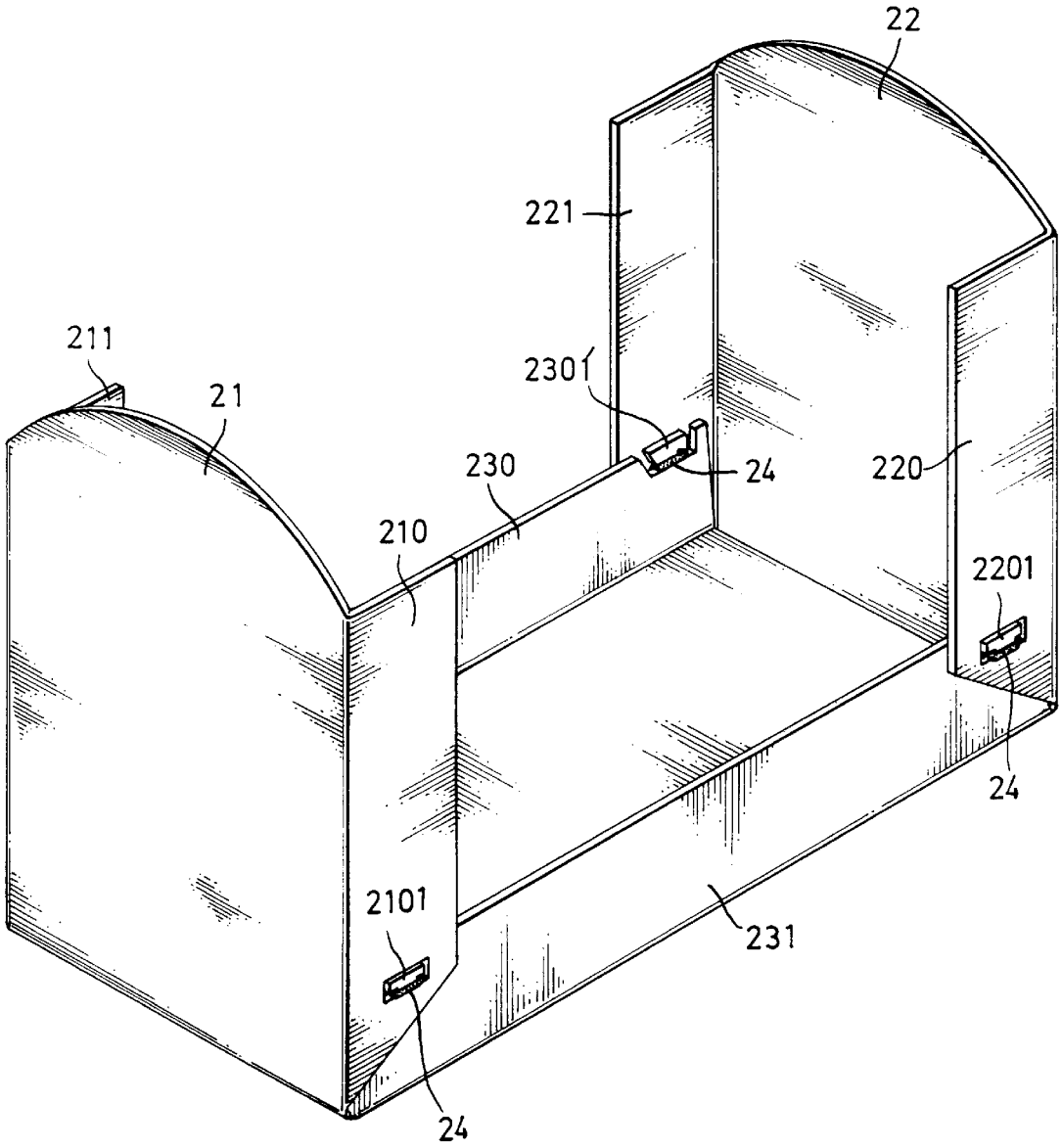
FIG. 12 is a perspective view of the bag expander according to the second embodiment of the present invention.
Figure 14:
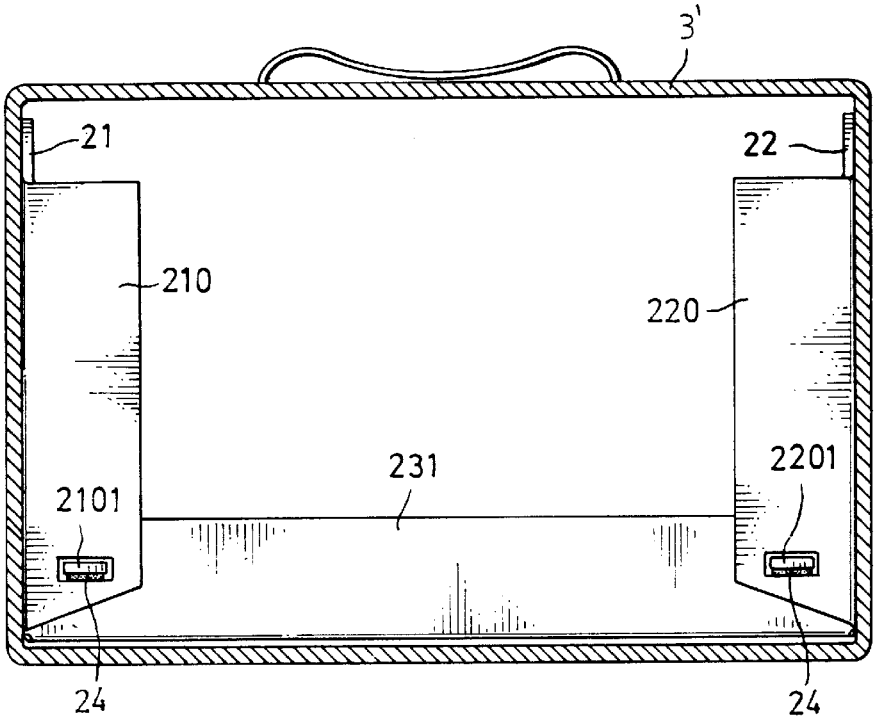
FIG. 14 is a sectional view showing the travel bag and the bag expander of the second embodiment of the present invention expanded.
Figure 13:
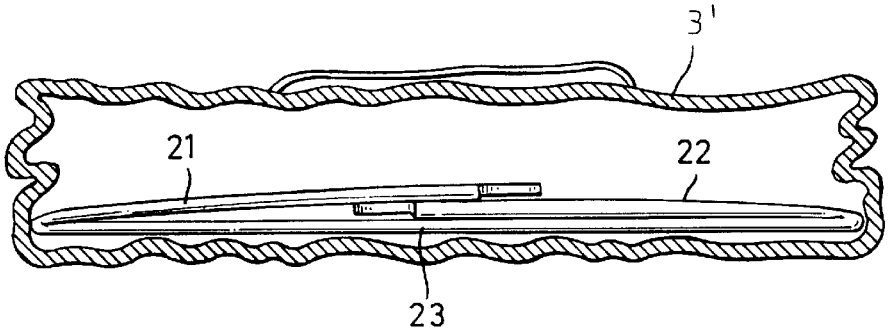
FIG. 13 is a sectional view showing the bag expander of the second embodiment of the present invention installed in a travel bag and collapsed with the travel bag.

FIGS. 11 and 12 show an alternate form of the present invention. According to this alternate form, the collapsible bag expander is made of a patterned carboard comprising a rectangular bottom panel 23 having two short sides and two long sides, two opposite side panels 21 and 22 respectively extended from the short sides of the bottom panel 23, two bottom panel reinforcing flaps 230 and 231 respectively extended from the long sides of the bottom panel 23, and two pairs of side panel reinforcing flaps 210 and 211; 220 and 221 respectively extended from the side panels 21 and 22 at two opposite sides in longitudinal alignment with the bottom panel reinforcing flaps 230 and 231. The bottom panel reinforcing flaps 230 and 231 each have two hooked portions 2301 and 2301'; 2311 and 2311' near two distal ends. The side panel reinforcing flaps 210 and 211; 220 and 221 each have a hooked portion 2101 or 2111; 2201 or 2211 disposed near one end.

Figure 15:
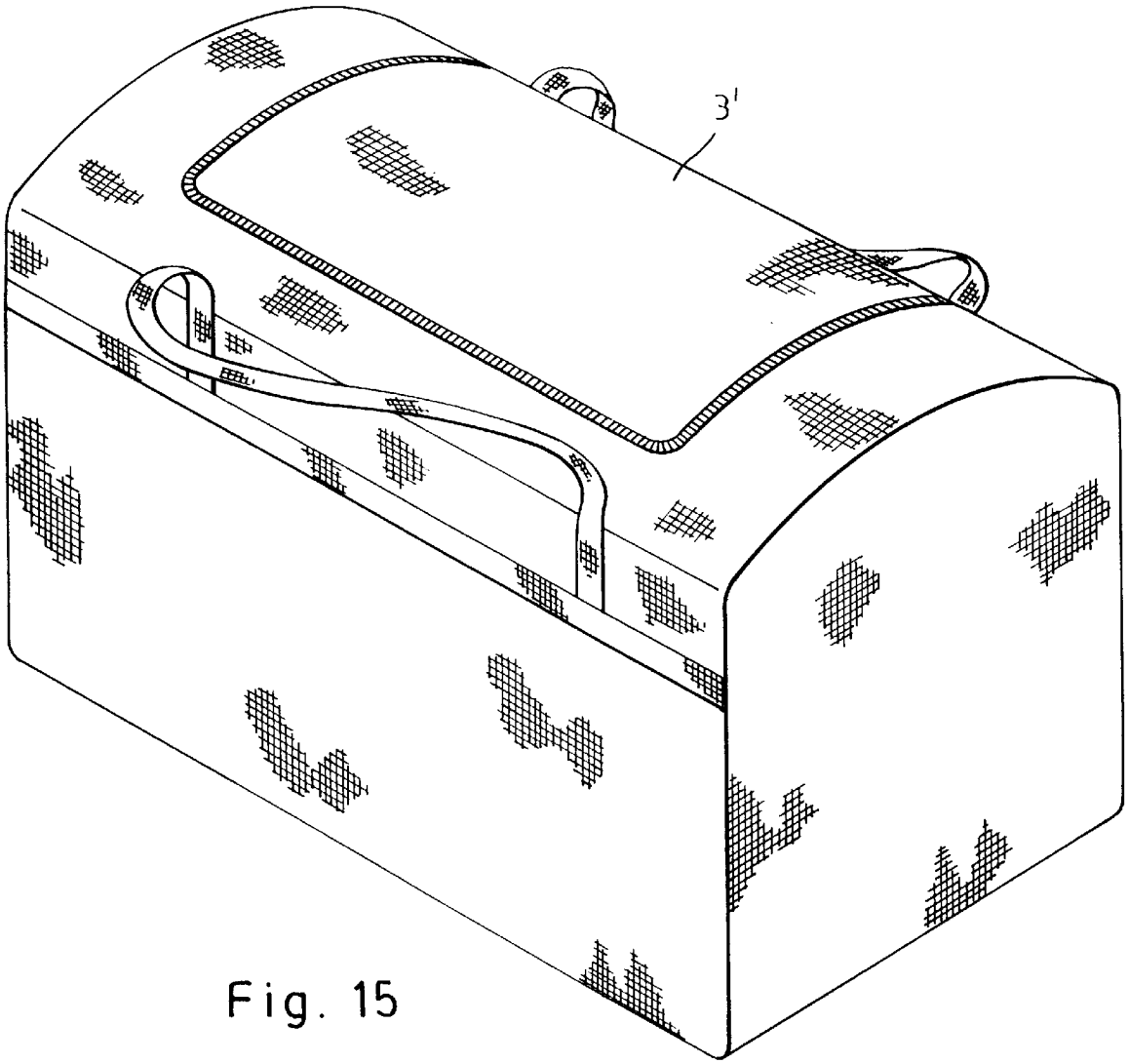
FIG. 15 is a perspective view of FIG. 14.

Referring to Figures from 13 through 15 and FIGS. 11 and 12 again, the side panel reinforcing flaps 210 and 211; 220 and 221 and the bottom panel reinforcing flaps 230 and 231 are respectively bent inwards through 90° angle, and then the side panels 21 and 22 are respectively bent inwards through 90° angle, and then the hooked portions 2301 and 2301'; 2311 and 2311' of the bottom panel reinforcing flaps 230 and 231 are respectively hooked up with the hooked portions 2101 and 2111; 2201 and 2211 of the side panel reinforcing flaps 210 and 211; 220 and 221 to hold the bag expander in the operative position as shown in FIG. 12, and then elastic bands 24 are respectively fastened to each matched pair of hooked portions 2101 and 2311; 2111 and 2301; 2201 and 2311'; 2211 and 2301'. When in use, the side panel reinforcing flaps 210 and 211; 220 and 221 are respectively bend inwards to force the bottom panel reinforcing flaps 230 and 231 inwards, and then the side panels 21 and 22 are respectively bent inwards and closely attached to the surface of the bottom panel 23, and then the collapsed bag expander is inserted into a travel bag 3', and then the travel bag 3' is Packed in a polybag (not shown) and retained in the collapsed condition. After removal of the travel bag 3' from the polybag, the travel bag 3' is shaked with the hands, enabling the bag expander to be forced by the spring power of the elastic bands 24 from the collapsed position to the extended position to support the travel bag 3' in shape (see FIG. 15).

What is claimed is:

1. A collapsible bag expander installed in a collapsible bag to support the collapsible bag in shape, comprising:

a patterned cardboard, said patterned cardboard comprising a base panel, said base panel having a top side, a bottom side, and two opposite lateral sides, two opposite side panels extended from the two opposite lateral sides of said base panel, a bottom panel extended from the bottom side of said base panel, two supporting flaps respectively longitudinally extended from said side panels at a top side, and two coupling flaps respectively transversely extended from two opposite lateral sides of said bottom panel in reversed directions, said side panels each having a hooked portion remote from said supporting flaps, said coupling flaps each having a hooked portion respectively hooked up with the hooked portions of said side panels; and two elastic bands respectively fastened to the coupled hooked portions of said side panels and said coupling flaps.

2. A collapsible bag expander comprising:

a patterned cardboard, said patterned cardboard comprising a rectangular bottom panel having two short sides and two long sides, two opposite side panels respectively extended from the short sides of said bottom panel, two bottom panel reinforcing flaps respectively extended from the long sides of said bottom panel, and two pairs of side panel reinforcing flaps respectively extended from said side panels at two opposite sides, said bottom panel reinforcing flaps each having two hooked portions near two distal ends, said side panel reinforcing flaps each having a hooked portion disposed near one end and respectively hooked up with the hooked portions at said bottom panel reinforcing flaps and a plurality of elastic bands respectively fastened to the coupled hooked portions at said side panel reinforcing flaps and said bottom panel reinforcing flaps.

* * * * *